US008056835B2

(12) United States Patent
Helleson

(10) Patent No.: US 8,056,835 B2
(45) Date of Patent: Nov. 15, 2011

(54) SELF-PRIMING NOZZLE FOR USE WITH FLUID DISPENSING EQUIPMENT

(75) Inventor: Gary M. Helleson, Harvest, AL (US)

(73) Assignee: Graco Minnesota Inc., Minneapolis, MN (US)

( * ) Notice: Subject to any disclaimer, the term of this patent is extended or adjusted under 35 U.S.C. 154(b) by 378 days.

(21) Appl. No.: 12/297,029

(22) PCT Filed: Mar. 12, 2007

(86) PCT No.: PCT/US2007/063764

§ 371 (c)(1),
(2), (4) Date: Nov. 8, 2008

(87) PCT Pub. No.: WO2007/121008

PCT Pub. Date: Oct. 25, 2007

(65) Prior Publication Data

US 2009/0108101 A1 Apr. 30, 2009

Related U.S. Application Data

(60) Provisional application No. 60/744,815, filed on Apr. 13, 2006.

(51) Int. Cl.
*B05B 1/30* (2006.01)

(52) U.S. Cl. ... 239/583; 239/337; 222/162; 222/402.13; 222/402.2; 137/230

(58) Field of Classification Search ..... 239/337, 239/583; 137/230, 231, 234; 222/162, 402.13, 222/402.2

See application file for complete search history.

(56) References Cited

U.S. PATENT DOCUMENTS

| | | | | |
|---|---|---|---|---|
| 2,442,361 | A | | 6/1948 | Hulman |
| 2,672,153 | A | * | 3/1954 | Kipp ..... 137/226 |
| 2,915,015 | A | | 12/1959 | Erikson et al. |
| 2,931,314 | A | | 4/1960 | Erikson et al. |
| 3,450,147 | A | * | 6/1969 | Webb ..... 137/226 |
| 3,635,604 | A | | 1/1972 | Peterson et al. |
| 4,021,155 | A | | 5/1977 | Erikson et al. |
| 4,072,048 | A | * | 2/1978 | Arvan ..... 73/146.8 |
| 4,464,929 | A | * | 8/1984 | Willis ..... 73/146.8 |
| 4,480,970 | A | | 11/1984 | Smith |
| 4,619,588 | A | | 10/1986 | Moore, III |
| 5,368,068 | A | | 11/1994 | Hunsberger et al. |
| 5,692,679 | A | | 12/1997 | Marran et al. |

* cited by examiner

*Primary Examiner* — Dinh Nguyen
(74) *Attorney, Agent, or Firm* — Douglas B. Farrow

(57) ABSTRACT

A self-priming nozzle device (20) comprising a nozzle sleeve (9), a nozzle body (1) comprising a nozzle body aperture (16), a sleeve portion (15) and an attachment portion (14), wherein the sleeve portion (15) attached to said attachment portion (14), and the sleeve portion (15) of the nozzle body (1) fits in the nozzle sleeve (9), a nozzle stem (3) comprising a stopper (21), an O-ring (4), and a rod portion (23), wherein said stopper (21) attached to said rod portion (23), and said O-ring (4) is positioned around said rod portion (23) near about said stopper (21), and said nozzle stem (3) is placed inside said nozzle sleeve (9) and said nozzle body aperture (16), and said stopper (21) located within said nozzle sleeve (9), a spring loaded component (25) comprising a plurality of washers (2*a*, 2*b*), a compression spring (6) and a compression element (5), and said spring loaded component (25) positioned on said rod portion (23) of nozzle stem (3), and said compression element (5) is attached to said rod portion (23) of nozzle stem (3).

7 Claims, 4 Drawing Sheets

SELF-PRIMING NOZZLE FOR USE WITH FLUID DISPENSING EQUIPMENT

Figure 1:
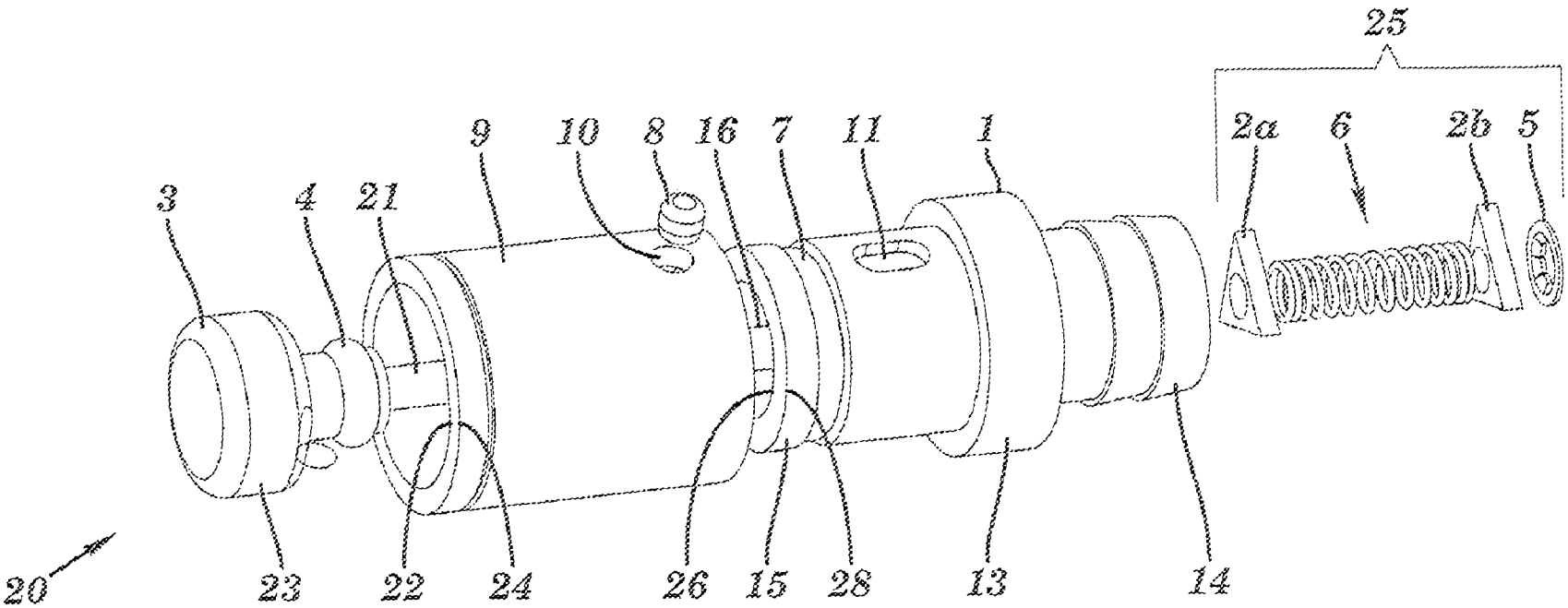

This application claims the benefit of U.S. Application Ser. No. 60/744,815 that was filed an Apr. 13, 2006.

TECHNICAL FIELD

Field of Invention

This invention generally related to nozzles, specifically self-priming nozzle for use with fluid dispensing equipment.

BACKGROUND OF INVENTION

A common method of pumping fluids involves employing an internal or external gear set. The operating principal of the gear set is that as the volume of fluid changes with gear motion, a pressure differential is created which produces fluid flow. There are several pumps available in the market that utilize this technique. The two major types of gear pumps include spur gears (external) and rotor gears (internal).

A common problem with using these elements as the driving force is that they have difficulty compressing air. Prior to installing the pump onto a reservoir of fluid, the pump is filled with air. In order to allow the system to prime, the pump must displace this air to create the pressure differential previously mentioned. The most prevalent method of overcoming this issue is handled by having the end user dismantle a portion of the pump and pour a higher density fluid into the gear set housing, eliminating the requirement of compressing air. This will provide a compression ratio that is large enough to allow the pump to prime.

There are some disadvantages to this method. There is extra work and inconvenience required by the end user to take the pump apart, pour fluid into the gear housing and reassemble the pump. In eases where dismantling the pump is not required, the pump requires long periods of time to prime. The extended period of time to prime decreases the life of the pump as the gears see increased wear when running without lubrication. Also gear pumps are typically sensitive to debris, which can cause leak paths and reduce pump performance. The requirement, to dismantle in the field could continue to increase, the possibility of the above-mentioned problems.

SUMMARY OF INVENTION

In one embodiment, the present invention provides a self-priming nozzle device including a nozzle sleeve comprising an inner and outer wall, a nozzle body comprising a nozzle body aperture, a sleeve portion with an inner and outer wail, and an attachment portion, wherein the sleeve portion attached to said attachment portion, and the outer wall of the sleeve portion of the nozzle body fits the inner wall of the nozzle sleeve, a nozzle stem comprising a stopper, an O-ring, and a rod portion, wherein said stopper attached to said rod portion, and said O-ring is positioned around said rod portion near about said stopper, and said nozzle stem is placed inside said nozzle sleeve and said nozzle body aperture, and said stopper located within the inner wall of said nozzle sleeve, a spring loaded component comprising a plurality of washers, a compression spring with two free ends and a compression element, wherein at least one washer is located on each free end of said compression spring, and said spring loaded component positioned on said rod portion of nozzle stem, and said compression element is attached to said rod portion of nozzle stem.

In another aspect of the present invention, preferably the stopper of said nozzle stern includes a plurality of concavities. Preferably the self-priming nozzle device includes the compression element as a push-nut.

In another aspect, preferably the self-priming nozzle device where the plurality of washers is triangular shaped including three vertices and each vertex touches the inner wall of the nozzle body aperture. Preferably the nozzle body further includes a blocking component attached to said outer wail of the sleeve portion of said nozzle body. Preferably the nozzle body further includes an O-ring where the O-ring positioned around said outer wall of said sleeve portion.

In another aspect, the self-priming nozzle device further includes a dowel pin, wherein said nozzle sleeve comprising an dowel aperture traversing said inner and outer wails of said nozzle sleeve and said sleeve portion of said nozzle body comprising an elongated dowel aperture traversing said inner and outer walls of said sleeve portion, and said dowel pin initially inserted into said dowel aperture and then said elongated dowel aperture.

In another aspect, the self-priming nozzle device where the nozzle sleeve, the nozzle body, the nozzle stem, the plurality of washers, the compression element, and the dowel pin are corrosion resistant.

One advantage of a self-priming nozzle includes a convenient method of priming a gear pump without the need for dismantling the pump. This also results in reduced down time and longer pump life. The present invention allows for a convenient and easy method to prime a gear driven pump used in oil dispensing applications.

BRIEF DESCRIPTION

The accompanying drawing is included to provide a further understanding of the present invention and is incorporated in and constitutes a part of this specification. The drawing illustrates embodiments of the present invention that serve to further explain the invention. Other aspects and advantages of the present invention will be understood by reference to the following Detailed Description when considered in connection with the accompanying drawing; and wherein:

FIG. 1: a side view of a self-priming nozzle according to the present invention.

Figure 2:
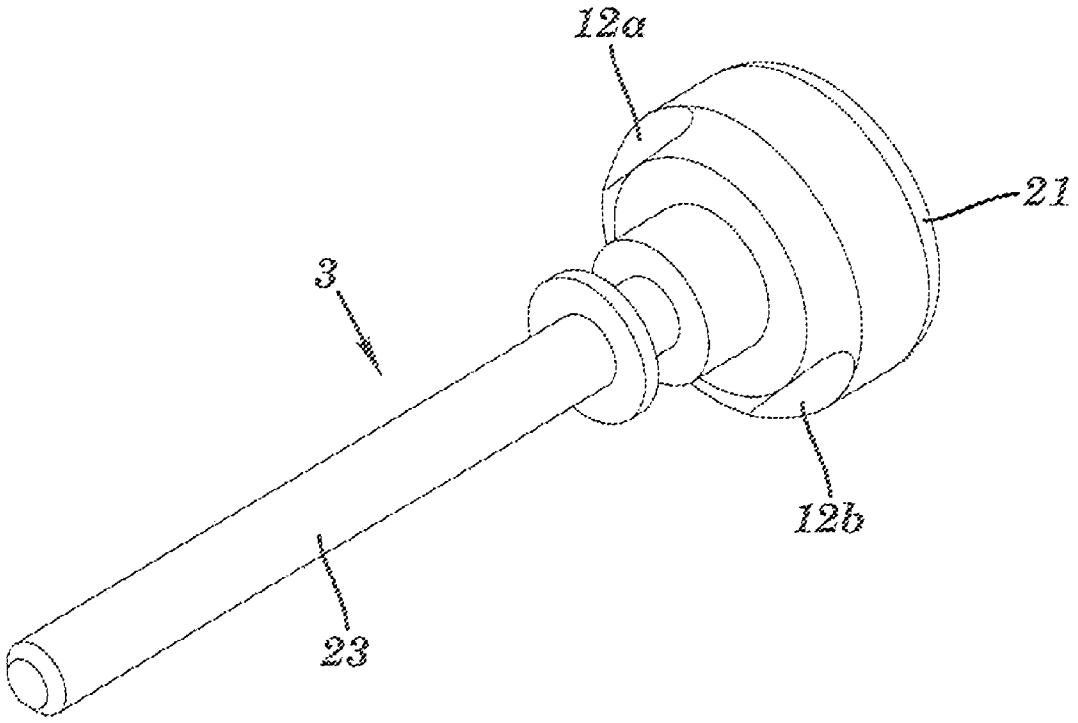

FIG. 2: a side view of a nozzle stem of a self-priming nozzle according to the present invention.

Figure 3:
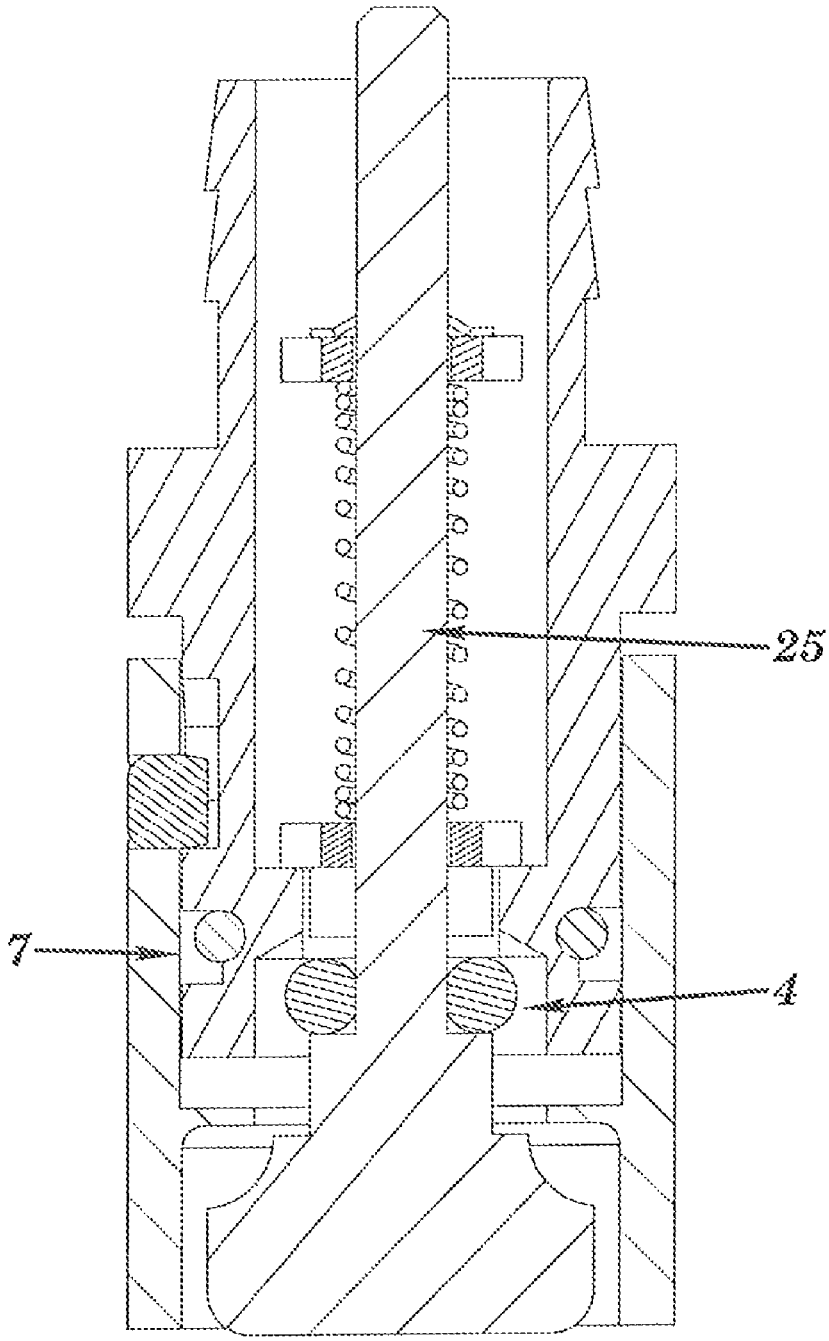

FIG. 3: a sectioned view of an activated state of a self-priming nozzle according to the present invention.

Figure 4:
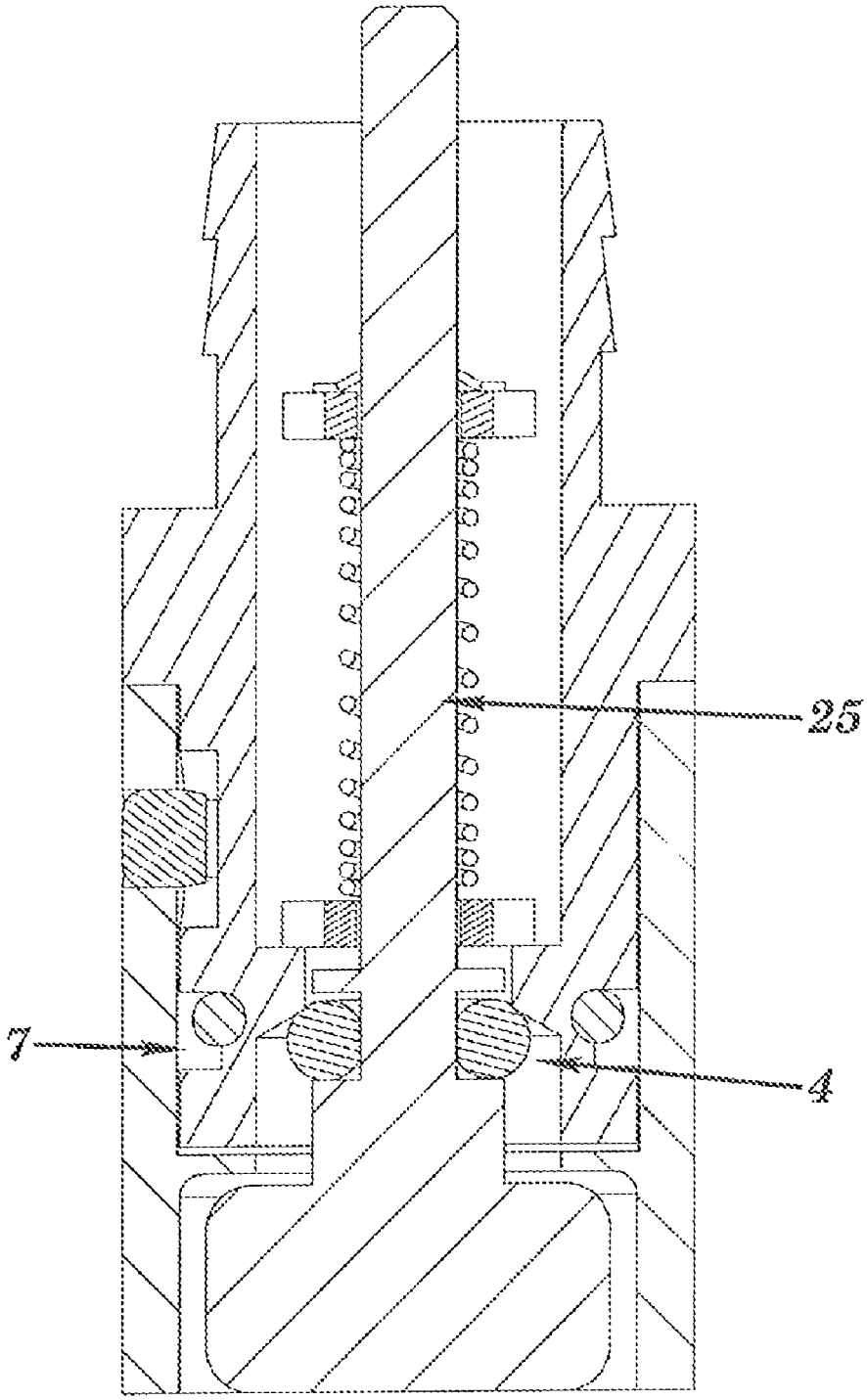

FIG. 4: a sectioned view of a deactivated state of a self-priming nozzle according to the present invention.

DETAILED DESCRIPTION

Referring to FIG. 1, a self-priming nozzle device 20 comprising a nozzle sleeve 9 comprising an inner and outer wail 22, 24, a nozzle body 1 comprising a nozzle body aperture 16, a sleeve portion 15 with an inner and outer wail 26, 28, and an attachment portion 14, wherein the sleeve portion 15 attached to said attachment portion 14, and the outer wall 28 of the sleeve portion 15 of the nozzle body 1 fits the inner wall 26 of the nozzle sleeve 9, a nozzle stem 3 comprising a stopper 21, an O-ring 4, and a rod portion 23, wherein said stopper 21 attached to said rod portion 23, and said. O-ring 4 is positioned around said rod portion 23 near about said stopper 21, and said nozzle stem 3 is placed inside said nozzle sleeve 9 and said nozzle body aperture 16, and said stopper 21 located within the inner wall 22 of said nozzle sleeve 9.

A spring loaded component 25 comprising a plurality of washers 2*a*, 2*b*, a compression spring 6 with two free ends and a compression element 6, wherein at least one washer 2*a* is located on each free end of said compression spring 6, and said spring-loaded component 25 positioned on said rod portion 23 of nozzle stem 3, and said compression element 5 is attached to said rod portion 23 of nozzle stem 3. The spring loaded mechanism must be compressed enough so that it is smaller than the nozzle stem. When die compression spring and thus the spring loaded mechanism is compressed, the pressure it takes to open up the present invention changes. In addition, the size of the spring loaded mechanism including the plurality of washers, the compression element, and compression spring should be small enough so that fluid can pass. The compression spring is usually made up of music wire, or steel.

Again referring to FIG. 1, other preferred embodiments of the present invention include the compression element 5 as a push-nut. But the compression element according to the present invention could be a push-nut, weld onto the stem, or any other attaching mean that can hold the compression spring in a compressed state. Preferably, the plurality of washers 2*a*, 2*b* are triangular shaped including three vertices and each vertex touches the inner wall 26 of the nozzle body aperture 16.

Another preferred embodiment further includes a dowel pin 8, wherein said nozzle sleeve 15 comprising an dowel aperture 10 traversing said inner and outer walls 22, 24 of said nozzle sleeve 9 and said sleeve portion 15 of said nozzle body 1 comprising an elongated dowel aperture 11 traversing said inner and outer walls 26, 28 of said sleeve portion 15, and said dowel pin 8 initially inserted into said dowel aperture 10 and then said elongated dowel aperture 11.

Referring to FIG. 2, another preferred embodiment according to the present invention includes the stopper 21 of said nozzle stem 3 comprising a plurality of concavities 12*a*, 12*b*.

Referring to FIG. 3-4, other preferred embodiments include the nozzle body further comprising a blocking component 13 attached to said outer wall 28 of the sleeve portion 15 of said nozzle body and an O-ring 7 wherein said O-ring 7 positioned around said outer wall 28 of said sleeve portion 15. The blocking component prevents die sleeve from moving too far over the nozzle body.

Advantages of a self-priming nozzle include the ability to remove air while priming and the ability to maintain a prime when the pump is not in use. In the FIG. 3, the end user extends the nozzle sleeve when attempting to prime the pump. This action will also extend the nozzle stem, which provides a path to allow air to escape from the pump. The nozzle stem 3 includes a plurality of concavities 12*a*, 12*b* that provide the aforementioned path.

Once primed, the pump will continue to hold a prime due to the independent motion of the nozzle stem 3 within the nozzle sleeve 9. When the nozzle sleeve 9 is extended, it will force the nozzle stem 3 to move along the same axis of motion. This movement breaks the O-ring 4 seal and allows the pump to prime. However, the motion of the nozzle stern 3 is independent of the nozzle sleeve 9.

During normal operation, the pump creates pressure, which drives fluid flow. This pressure is used to move the spring loaded nozzle stem 3 and allow fluid to flow. Referring to FIG. 4, when the pump is deactivated, the pressure of the system decays and the spring loaded component 25 returns to its sealed state. Other designs could include a mechanism that forces the nozzle stem 3 to move forward by way of a plunger or rotating cam located at the base of the nozzle stem.

A preferred embodiment according to the present invention 20 would include a method of allowing the pump to displace air from the system at the nozzle. This method requires a physical action by the end user. Another embodiment according to the present invention would include a method of sealing at the nozzle to prevent the pump from losing prime when not in use. It is not required for this method to be automatic, but this is seen as a benefit, as the end user is not required to remember to seal the system at the end of each dispense.

The attachment portion 14 of the nozzle body 1 can be barb fitted for attaching a rubber hose or could be threaded to fit steel tubing. Also, the present invention 20 should be used in connection with electric pumps and cannot be used for an air or hydraulic pump. Another embodiment of the present invention could dispense fuel, water, and oil. And the material should be selected accordingly to deal with the properties of the chosen fluid.

Another preferred embodiment according to the present invention 20, where the nozzle sleeve 9, the nozzle body 1, the nozzle stem 3, the plurality of washers 2*a*, 2*b*, the compression element 5, and the dowel pin 8 are corrosion resistant.

It is contemplated that various changes and modifications may be made to the self-priming nozzle for use with fluid dispensing equipment without departing from the spirit and scope of the invention as defined by the following claims.

What is claimed is:

1. A self-priming nozzle device comprising:

a nozzle sleeve comprising an inner and outer wall;

a nozzle body comprising a nozzle body aperture, a sleeve portion with an inner and outer wall, and an attachment portion, wherein the sleeve portion attached to said attachment portion, and the outer wall of the sleeve portion of the nozzle body fits the inner wall of the nozzle sleeve;

a nozzle stem comprising a stopper, an O-ring, and a rod portion, wherein said stopper is attached to said rod portion, and said O-ring is positioned around said rod portion near about said stopper, and said nozzle stem is placed inside said nozzle sleeve and said nozzle body aperture, and said stopper located within the inner wall of said nozzle sleeve and wherein the stopper of said nozzle stem comprises a plurality of concavities;

a spring loaded component comprising a plurality of washers, a compression spring with two free ends and a compression element, wherein at least one washer is located on each free end of said compression spring, and said spring loaded component positioned on said rod portion of nozzle stem, and said compression element is attached to said rod portion of nozzle stem.

2. The self-priming nozzle device according to claim 1, wherein the compression element is a push-nut.

3. The self-priming nozzle device according to claim 2, wherein the plurality of washers are triangular shaped including three vertices and each vertex touches the inner wall of the nozzle body aperture.

4. The self-priming nozzle device according to claim 3, wherein the nozzle body further comprising a blocking component attached to said outer wall of the sleeve portion of said nozzle body.

5. The self-priming nozzle device according to claim 4, wherein the nozzle body further comprising an O-ring wherein said O-ring positioned around said outer wall of said sleeve portion.

6. The self-priming nozzle device according to claim 5, further comprising a dowel pin, wherein said nozzle sleeve comprising an dowel aperture traversing said inner and outer walls of said nozzle sleeve and said sleeve portion of said nozzle body comprising an elongated dowel aperture traversing said inner and outer walls of said sleeve portion, and said dowel pin initially inserted into said dowel aperture and then said elongated dowel aperture.

7. The self-priming nozzle device according to claim 6, wherein the nozzle sleeve, the nozzle body, the nozzle stem, the plurality of washers, the compression element, and the dowel pin are corrosion resistant.

* * * * *